US006014989A

United States Patent [19]

Tachon et al.

[11] Patent Number: 6,014,989

[45] Date of Patent: Jan. 18, 2000

[54] DEVICE FOR CONNECTING A HEDDLE TO A HARNESS CORD

[75] Inventors: Michel Tachon, Lyons; Patrick Vessella, Decines Charpieu, both of France

[73] Assignee: Staubli Lyon, Chassieu, France

[21] Appl. No.: 09/184,068

[22] Filed: Nov. 2, 1998

[30] Foreign Application Priority Data

Nov. 5, 1997 [FR] France ..... 97 14181

[51] Int. Cl.[7] ..... D03C 3/40

[52] U.S. Cl. ..... 139/88; 139/85; 24/374; 24/115 R

[58] Field of Search ..... 139/85, 88; 24/370, 24/374, 115 R

[56] References Cited

U.S. PATENT DOCUMENTS

| | | | |
|---|---|---|---|
| 1,720,272 | 7/1929 | Harris | 139/85 |
| 2,700,398 | 1/1955 | Green | 139/85 |
| 3,736,962 | 6/1973 | Rademacher | 139/85 |
| 5,309,950 | 5/1994 | Bassi et al. . | |
| 5,671,782 | 9/1997 | Lemaire et al. . | |

FOREIGN PATENT DOCUMENTS

| | | |
|---|---|---|
| 546967 | 12/1992 | European Pat. Off. . |
| 2114285 | 6/1972 | France . |
| 2212891 | 7/1974 | France . |
| 906119 | 5/1987 | France . |
| 2722514 | 7/1995 | France . |
| 1735018 | 7/1970 | Germany . |
| 1491979 | 11/1977 | Germany . |
| 19526177 | 1/1996 | Germany . |
| WO 98/35080 | 2/1997 | WIPO . |

*Primary Examiner*—Andy Falik
*Attorney, Agent, or Firm*—Dowell & Dowell, P.C.

[57] ABSTRACT

A device for connecting a heddle of a weaving loom to a harness cord which includes an endpiece adapted to be molded on an upper end of the heddle and which end piece forms an orifice for receiving one of the harness cords. A sheath is provided for surrounding a harness cord passing through the orifice to thereby provide a structure wherein interference between adjacent heddles is avoided.

20 Claims, 3 Drawing Sheets

DEVICE FOR CONNECTING A HEDDLE TO A HARNESS CORD

BACKGROUND OF THE INVENTION

1. Field of the Invention

The present invention relates to a device for hooking a heddle of a weaving loom of Jacquard type to a cord belonging to a harness. The invention also relates to a weaving loom heddle equipped with such a device and to a weaving loom equipped with such a heddle.

2. Brief Description of the Related Art

Each hook of a Jacquard mechanism is known to be associated with a harness cord to which a plurality of cords are connected, the assembly of these cords constituting the harness of the Jacquard mechanism. In its lower part, each cord is hooked to the upper end of a heddle which comprises a mail for passage of a warp yarn.

The heddles are generally formed by metal wires. It is known, particularly from FR-A-2 212 891, to bend the upper end of each heddle so as to constitute a loop for passage of the cord, the cord being maintained in position in this loop thanks to a possibly heat-retractable sheath or any other appropriate means.

In this type of device, it is necessary to bend the end of each heddle precisely, which is a relatively delicate maneuver, as the loop formed at the upper end of each heddle must have minimum dimensions in order not to bump against the ends of the adjacent heddles, it being understood that the density of the installed heddles of a weaving loom is high. With the known devices, it has proved to be difficult to master the transverse dimensions of the loops formed by bent-over wires, with the result that the sheaths which cover them rub against one another, this inducing overheating and premature wear of these sheaths which may disturb the functioning of the weaving loom.

In addition, in the known devices, the loop of metal wire essentially extends in a first plane containing the heddle, while the cord is disposed in a second plane substantially perpendicular to the first plane, with the result that the sheath which covers these two objects at the same time undergoes considerable deformations in two transverse dimensions. If the sheath is not flexible enough, it may tear or stretch in these two dimensions to the point of bumping against the sheaths of the adjacent heddles.

It is a particular object of the present invention to overcome these drawbacks by proposing a hooking device whose transverse dimensions may be mastered with high precision, while its cost remains attractive.

SUMMARY OF THE INVENTION

To that end, the invention relates to a device for hooking a heddle of a weaving loom of the Jacquard type to a cord belonging to a harness, characterized in that it comprises an endpiece molded on the upper end of the heddle, this endpiece forming an orifice for passage and for wedging of the cord in cooperation with a sheath.

The use of a molded endpiece makes it possible to define the dimensions of this endpiece with high precision and to obtain a substantial saving of time with respect to an operation of bending a metal wire into a loop. The hooking devices thus have the same dimensions, in particular the same transverse dimensions, with the result that the risks of friction on one another of the sheaths which cover them, may be substantially reduced, even eliminated. The invention even enables sheaths which are not thermo-retractable to be used, insofar as the force of wedging obtained with the device of the invention and a non-retracted sheath may be greater than that of the known devices. This aspect of the invention therefore economizes on the step of heating the sheath with a view to deforming it around the end of the heddle.

According to a first advantageous aspect of the invention, the endpiece comprises two flexible branches adapted to deform in order to reduce the apparent diameter of the endpiece, particularly under the effect of a force exerted by the sheath. Thanks to this aspect of the invention, the orifice defined between the branches has, in the absence of pinching effort exerted thereon, a sufficient opening to allow easy introduction of the cord in this orifice when it is being positioned. When the cord is in place, the branches may be brought closer together thanks to their flexible nature in order to reduce the apparent diameter of the endpiece with a view to minimizing the risks of contact or friction between the sheaths which cover these endpieces.

According to another advantageous aspect of the invention, portions of the endpiece in contact with the cord include parts in relief for retaining or hooking the cord.

According to another advantageous aspect of the invention, the endpiece comprises two branches extending from a common base molded around the end of the heddle, these two branches being joined, opposite the base, by a web of molded material of thickness less than the width of the branches. Thanks to this aspect of the invention, the cord is naturally disposed around the web of molded material between the branches, with the result that the thickness of the cord is partially concealed by the difference in thickness between the web and the branches, which contributes to giving the sheath an overall cylindrical outer appearance.

According to another advantageous aspect of the invention, the web defines two grooves for receiving the cord above the orifice. This aspect of the invention facilitates the location of the cord in the endpiece, which makes it possible efficiently to control the apparent transverse dimensions of it and of the sheath which covers it. In that case, the web may be provided to be bordered by two cheeks with which it forms a guide for the cord, the grooves being defined between these cheeks. The guide may in particular be provided to present a cross section substantially in the form of an H. In that case, the web constitutes the transverse bar of the H while the cheeks constitute the vertical bars thereof.

According to another advantageous aspect of the invention the upper end of the heddle is bent in at least one direction substantially perpendicular to its principal direction in order to improve the hooking of the endpiece on the heddle. For example, the upper end of the heddle may be provided to be in zigzag form, which increases its surface of contact with the base of the endpiece.

The invention also relates to a heddle of a weaving loom of Jacquard type, characterized in that it comprises a device for hooking to a harness cord as described hereinbefore. Such a heddle, whose cost is attractive, does not risk coming into contact with the adjacent heddles.

The invention also relates to a weaving loom of Jacquard type equipped with such heddles. Such a weaving loom may function at high speed without risk of overheating or premature wear.

BRIEF DESCRIPTION OF THE DRAWINGS

The invention will be more readily understood on reading the following description of an embodiment of a device for hooking a heddle of a weaving loom of Jacquard type, in accordance with its principle, given solely by way of example and made with reference to the accompanying drawings, in which.

DESCRIPTION OF PREFERRED EMBODIMENTS

Figure 1:
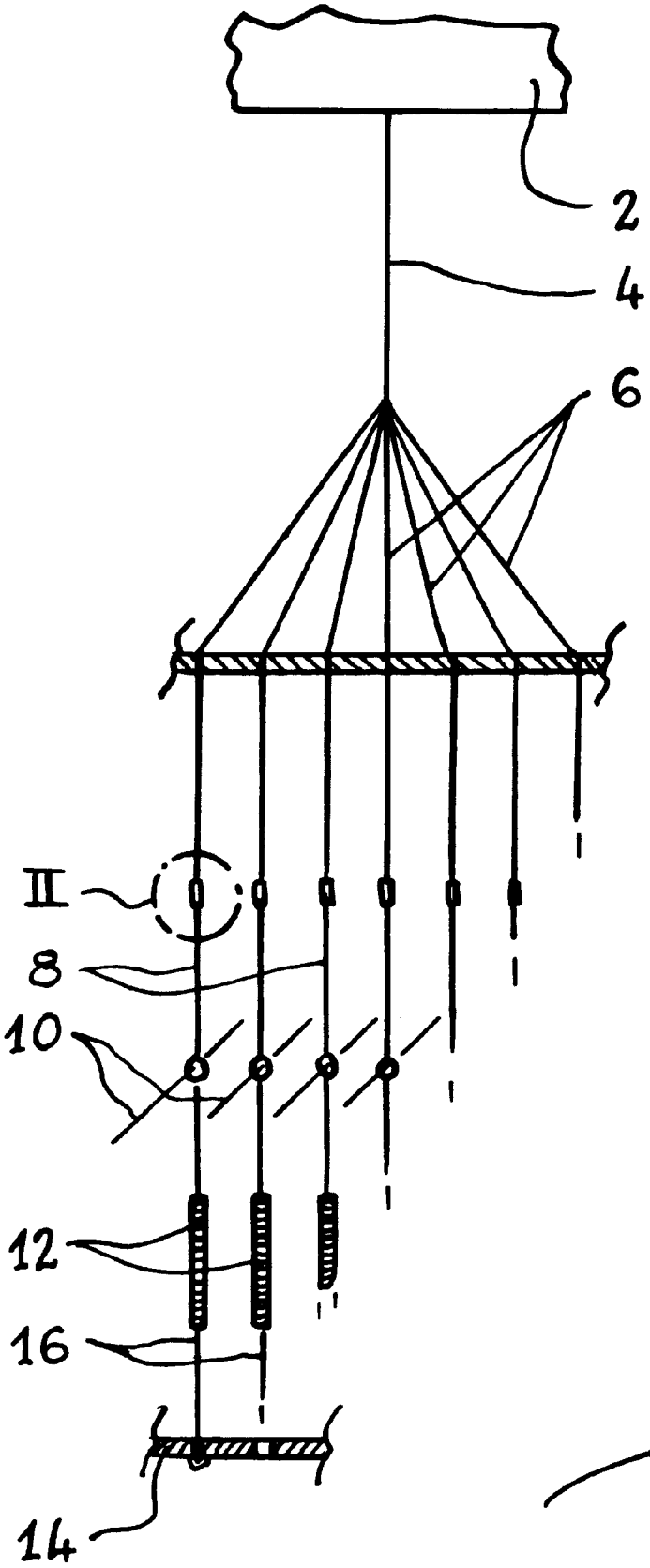
FIG. 1 is a schematic partial view of a weaving loom according to the invention.

Referring now to the drawings, FIG. 1 very schematically shows a Jacquard mechanism 2 of a weaving loom. This mechanism controls a plurality of harness cords of which only one, 4, has been shown. The lower end of this harness cord is associated with a plurality of cords 6. The assembly of the cords 6 forms the harness of the weaving loom.

Each cord 6 is hooked to the upper end of a heddle 8 for controlling the position of a warp yarn 10. Each heddle 8 is fixed by its lower part to a spring 12 fastened to a fixed anchoring frame 14 via a filar element 16.

Figure 2:
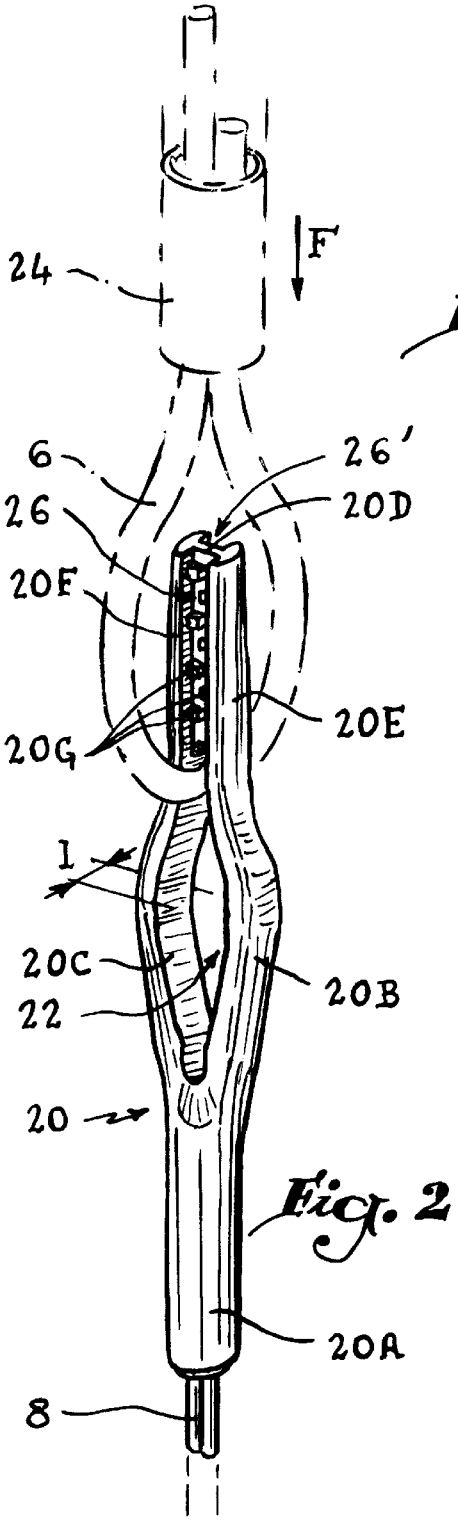
FIG. 2 is a view in perspective of the upper end of a heddle according to the invention equipping the loom of FIG. 1, when it is hooked to a cord of the harness.

The upper end of the heddle visible in FIG. 2 corresponds to the detail II of FIG. 1.

In accordance with the invention, an endpiece 20 is molded on the upper end 8A of each heddle 8. It will be noted that the end 8A of the heddle 8 is zigzagged, i.e. shaped in directions overall perpendicular to the principal direction of the heddle in order to improve hooking of the endpiece 20. This makes it possible to resist the relatively great efforts of traction that the heddle must withstand.

The endpiece 20 comprises a base 20A in which is molded the end 8A of the heddle 8, and two branches 20B and 20C joined, opposite the base 20A, by a web 20D of material moulded at the same time as the rest of the endpiece 20. The branches 20B and 20C thus define therebetween an orifice 22 inside which one of the cords 6 can be inserted.

Branches 20B and 20C are arcuate, with the result that the opening of the orifice 22 is relatively large with respect to the dimensions of the cord 6, this facilitating introduction thereof.

Figure 3:
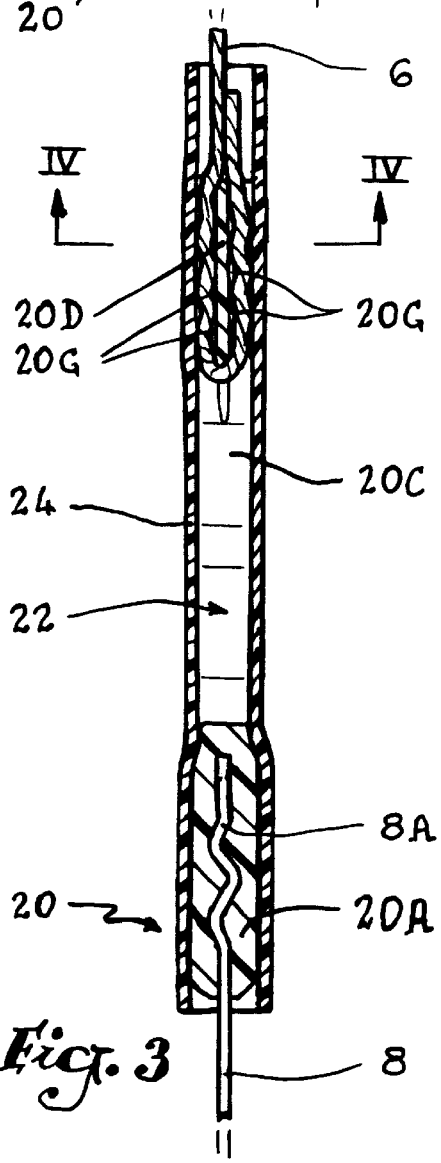
FIG. 3 is a vertical section of the upper end of the heddle of FIG. 2 hooked to a cord.

A sheath 24 is provided to be disposed around the cord 6 and the endpiece 20 when the cord 6 has been positioned as shown in FIG. 2, the sheath 24 then being displaced in the direction of arrow F. In accordance with another assembly procedure, the sheath 24 may be disposed around the heddle 8, below the endpiece 20 in FIG. 2, then slid around this endpiece to cover the loop formed by the cord 6 in a direction opposite that of arrow F. It will be understood that, when the sheath 24 is in place as shown in FIG. 3, the end of the cord 6 is firmly wedged in position.

The branches 20B and 20C extend respectively by elements 20E and 20F substantially of the same width I as the branches 20B and 20C. The elements 20E and 20F form cheeks disposed on either side of the web 20D. As shown more clearly in FIG. 4, the thickness e of the web 20D is less than the width I of the branches 20B and 20C and of elements 20E and 20F.

The assembly formed by elements 20D to 20F presents a cross section substantially in the form of an H and defines two grooves 26 and 26' for receiving the cord 6 on either side of the web 20D.

Figure 4:
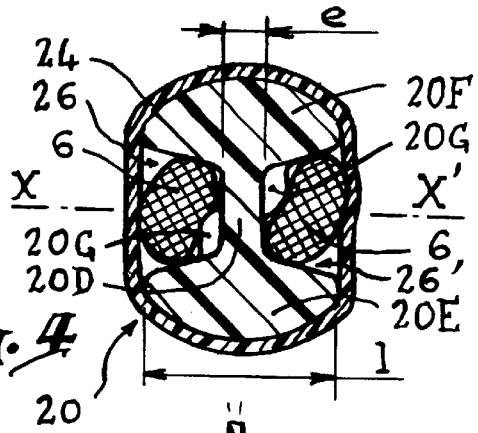
FIG. 4 is a section on a larger scale along line IV—IV in FIG. 3.

In this way, the cord 6 does not project substantially outside the endpiece 20 in a dimension represented by the axis XX' in FIG. 4.

The web 20D includes, on each of its lateral faces, cogs or projections 20G whose function is to increase the forces of friction of the cord 6 on the web 20D which constitutes the bottom of the grooves 26 and 26'. The cogs 20G are disposed on each lateral face of the web 20D along two rows respectively close to elements 20E and 20F, the cogs of each row being interposed between two cogs of the other row. This further improves the forces of friction and of wedging of the cord 6.

In the position of FIGS. 3 and 4, the sheath 24 exerts on the branches 20*b* and 20C a force which tends to decrease the section of the orifice 22 by moving the branches 20B and 20C, which are flexible, closer together. In this way, when the sheath 24 is in place, the apparent diameter of the endpiece 20 is small. In practice, and as shown in FIG. 4, it is defined by the radius of curvature of the outer surfaces of the branches 20B and 20C or of elements 20E and 20F.

Figure 5:
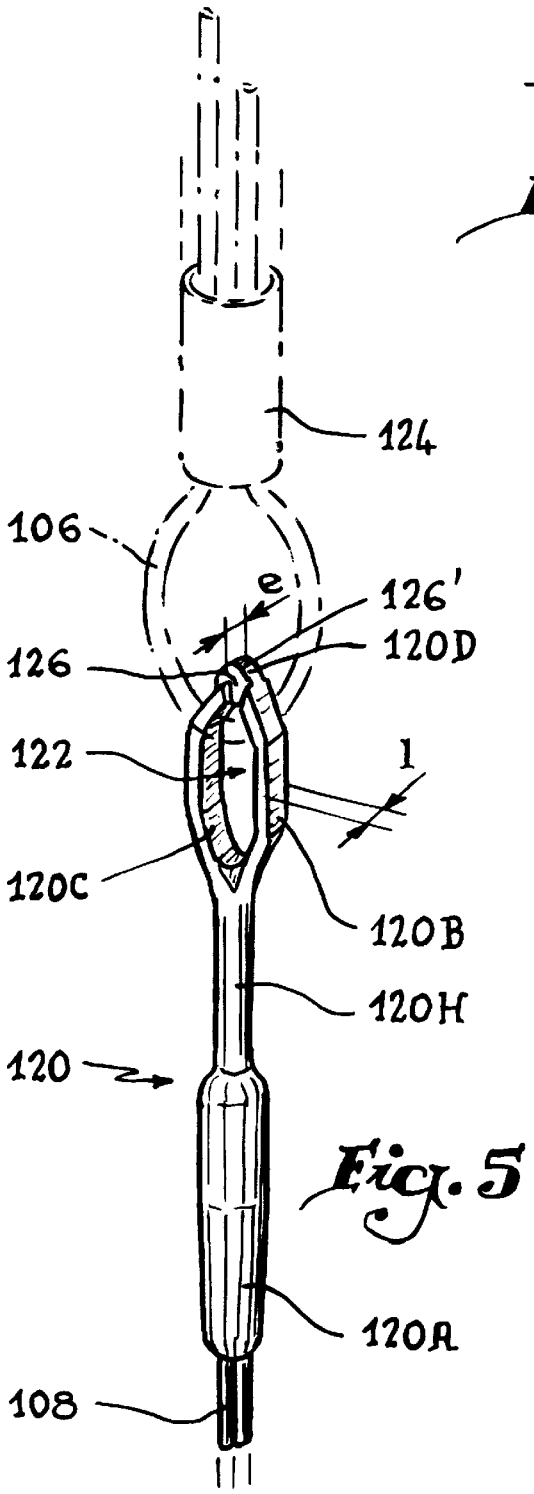
FIG. 5 is a view in perspective similar to FIG. 2 for the end of a heddle in accordance with a second embodiment of the invention.
Figure 7:
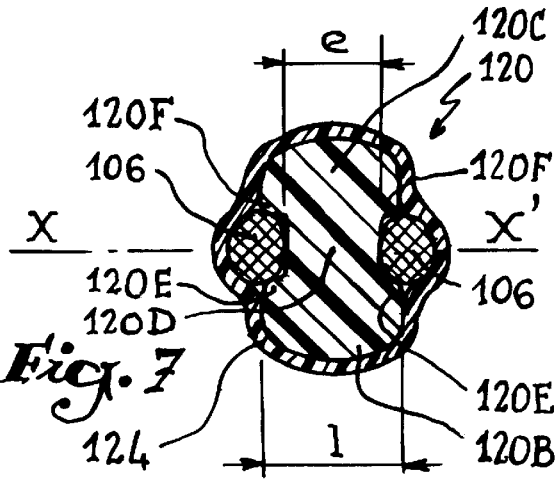
FIG. 7 is a section on a larger scale alone line VII—VII in FIG. 6.
Figure 6:
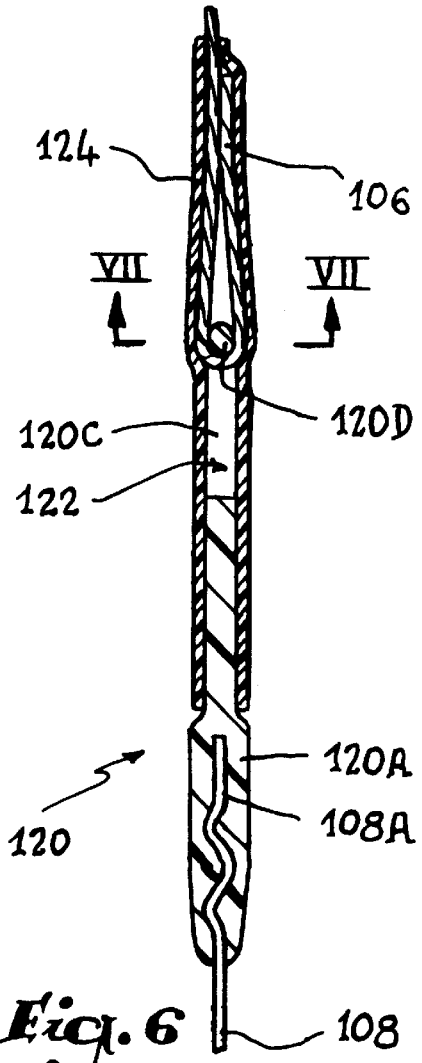
FIG. 6 is a view similar to FIG. 3 for the heddle end of FIG. 5.

In the second embodiment of the invention shown in FIGS. 5 to 7, the elements similar to those of the preceding embodiment have identical references increased by 100. In this embodiment, an endpiece 120 is molded on the upper end 108A of a heddle 108 in order to receive the lower end of a cord 106 which is covered by a sheath 124. The endpiece 120 comprises a base 120A extended by a rod 120H at the end of which are provided two branches 120B and 120C connected by a web 120D. The web 120D has a thickness e less than the width I of the branches 120B and 120C.

The upper ends of the branches 120B and 120C, which are wider than the web 120D, form shoulders 120E and 120F on either side of this web. These shoulders constitute cheeks between which are defined grooves 126 and 126' in which the cord 106 may be at least partially housed. This makes it possible to reduce the transverse dimensions of the endpiece 120 covered with the sheath 124 in the direction XX' visible in FIG. 7.

The width of the orifice 122 in which the cord 106 passes is reduced when the sheath 124 is placed in position as the branches 120B and 120C are flexible, this making it possible to move them closer by a pinching effort As is clearly apparent in FIG. 7, the assembly formed by elements 120B to 120D has a transverse section in the overall shape of an H, which enables it to serve as guide for the cord 106.

The endpiece 120 of this second embodiment is particularly adapted to cords of small diameter.

Whatever the embodiment in question the endpiece 20 or 120 may be made of any appropriate injectable thermoplastic material. These materials are light and present good mechanical properties of suppleness and shear resistance.

What is claimed is:

1. A device for connecting a heddle of a weaving loom of Jacquard-type to a cord belonging to a harness of the loom, the device comprising;

an endpiece adapted to be molded on an upper end of the heddle, said endpiece having an orifice adapted to receive a harness cord therethrough, and a sheath of a size to surround at least a portion of said endpiece and said orifice and adapted to secure a harness cord extending through said orifice to said endpiece.

2. The device of claim 1 wherein said endpiece includes a pair of branches which define said orifice therebetween, said branches being flexible toward one another by a force exerted by said sheath.

3. The device of claim 1 wherein said endpiece includes spaced protrusions adapted to engage a harness cord extending through said orifice.

4. The device of claim 1 wherein said endpiece includes a base adapted to be molded to the heddle, two branches extending from said base and being joined in spaced relationship to said base by a web of molded material to thereby define said orifice between said web and said base, and said web having a thickness dimension which is less than a width dimension of said branches.

5. The device of claim 4 wherein said web defines two oppositely oriented grooves between said branches, said grooves being adapted to receive a harness cord extending through said orifice therein.

6. The device of claim 5 wherein said sheath is of a size to surround said grooves between said branches to thereby secure a harness cord therein.

7. The device of claim 5 including a plurality of spaced projections extending into each of said grooves, said projections being formed in two rows in each of said grooves with said projections of one row being spaced offset from said projections of an opposite row.

8. The device of claim 4 wherein said branches define a pair of cheeks on opposite sides of said web, said cheeks and said web forming a guide for a harness cord extending through said orifice.

9. The device of claim 5 wherein said guide is generally H-shaped in cross section.

10. A combination of a heddle of a weaving loom of the Jacquard-type and a device for connecting the heddle to a cord of a harness of the loom, the combination comprising, a heddle having an upper portion, an endpiece molded on said upper portion of said heddle, said endpiece including an orifice adapted to receive a harness cord therethrough, and a sheath adapted to surround at least a portion of said endpiece and said orifice so as to secure a harness cord extending through said orifice to said endpiece.

11. The combination of claim 10 wherein said upper portion of said heddle is bent in at least one direction generally perpendicular to a principal direction of said heddle.

12. The device of claim 10 wherein said endpiece includes a pair of branches which define said orifice therebetween, said branches being flexible toward one another by a force exerted by said sheath.

13. The device of claim 10 wherein said endpiece includes spaced protrusions adapted to engage a harness cord extending through said orifice.

14. The device of claim 10 wherein said endpiece includes a base adapted to be molded to the heddle, two branches extending from said base and being joined in spaced relationship to said base by a web of molded material to thereby define said orifice between said web and said base, and said web having a thickness dimension which is less than a width dimension of said branches.

15. The device of claim 14 wherein said web defines two oppositely oriented grooves between said branches, said grooves being adapted to receive a harness cord extending through said orifice therein.

16. The device of claim 15 wherein said sheath is of a size to surround said grooves between said branches to thereby secure a harness cord therein.

17. The device of claim 15 including a plurality of spaced projections extending into each of said grooves, said projections being formed in two rows in each of said grooves with said projections of one row being spaced offset from said projections of an opposite row.

18. The device of claim 14 wherein said branches define a pair of cheeks on opposite sides of said web, said cheeks and said web forming a guide for a harness cord extending through said orifice.

19. The device of claim 18 wherein said guide is generally H-shaped in cross section.

20. In a weaving loom of the Jacquard-type which includes a harness including cords which are connectable to separate heddles, the improvement comprising;

a plurality of endpieces molded to upper ends of a plurality of the heddles, each of said endpieces including an orifice adapted to receive one of said harness cords therethrough, and a plurality of sheaths, each of said sheaths surrounding at least a portion of one of said plurality of endpieces and said orifices thereof so as to secure the harness cords to said endpieces.

* * * * *